US005815021A

United States Patent [19]

Shou et al.

[11] Patent Number: 5,815,021

[45] Date of Patent: Sep. 29, 1998

[54] WEIGHT ADDITION CIRCUIT

[75] Inventors: Guoliang Shou; Changming Zhou; Kazunori Motohashi; Makoto Yamamoto; Sunao Takatori, all of Tokyo, Japan

[73] Assignees: Yozan Inc., Tokyo; Sharp Kabushiki Kaisha, Osaka, both of Japan

[21] Appl. No.: 686,761

[22] Filed: Jul. 26, 1996

[30] Foreign Application Priority Data

Jul. 28, 1995 [JP] Japan ..... 7-212420

[51] Int. Cl.[6] ..... G06G 7/14; G06G 7/16

[52] U.S. Cl. ..... 327/361; 327/356

[58] Field of Search ..... 327/361, 336, 327/337, 339, 345, 352, 355–359, 363, 91, 94, 95, 96; 364/602, 606

[56] References Cited

U.S. PATENT DOCUMENTS 5,381,352 1/1995 Shou ..... 369/606
5,420,806 5/1995 Shou ..... 364/606
5,465,064 11/1995 Shou et al. ..... 327/361
5,469,102 11/1995 Shou ..... 327/361
5,565,809 10/1996 Shou et al. ..... 327/358
5,606,274 2/1997 Shou et al. ..... 327/94
5,617,053 4/1997 Shou et al. ..... 327/361

OTHER PUBLICATIONS

Takebe et al., Switched Capacitor Circuit, p. 48 Figure 3.13 and p. 49 Figure 3.14.

*Primary Examiner*—My-Trang Nu Ton
*Attorney, Agent, or Firm*—Cushman Darby & Cushman IP Group of Pillsbury Madison & Sutro LLP

[57] ABSTRACT

The present invention provides a weighted addition circuit for sampling, holding and performing weighted addition by a circuit smaller than a conventional one. In the weighted addition circuit of to the present invention, a capacitive coupling is connected to a plurality of switches which are further connected only to an input voltage. A voltage is held and a weight is added in the capacitive coupling.

6 Claims, 4 Drawing Sheets

WEIGHT ADDITION CIRCUIT

FIELD OF THE INVENTION

The present invention relates to a weighted addition circuit, especially to a weighted addition circuit for holding an analog voltage signal and for calculating the sum of voltage signals.

BACKGROUND OF THE INVENTION

Applicants proposed a multiplication circuit for multiplying a weight with sign to an analog voltage signal in Japanese patent publication number 06-215164, and a sampling and holding circuit for holding an analog voltage signal in Japanese patent publication 06-237148. As shown in FIG. 4, the multiplication circuit integrates an output of switch circuit SWC3 by capacitive coupling CP3, and a weight is added by each capacitance of a capacitive coupling. The switch circuit SWC3 includes a plurality of switches alternately connected to an input voltage Vin3 and a ground. An output of capacitive coupling CP3 is guaranteed linearity by two inverted amplifying portions INV31 and INV32, and feedback capacitances CF31 and CF32 which are connected thereto. A result of the weighted addition is output in real time.

As shown in FIG. 5, the sampling and holding circuit introduced above includes a switch SW41 connected to an input voltage Vin4, capacitances C41 and C42 connected to the output of the switch SW41, inverted amplifying portion INV41 connected to the capacitances and feedback capacitance CF41 for connecting an output of INV41 to an input. The electrical charge corresponding to Vin4 is held in C41 and C42 by closing SW41.

A switch SW42 is connected to an output of INV41, and capacitances C43 and CJ4 are connected to SW42. An inverted amplifying portion INV42 and feedback capacitance CF42 are connected to the capacitances. An output of INV42 is held in the capacitances, thereby guaranteeing the linearity of Vo4.

It is possible to perform weighted addition (calculating the sum of multiplication results) of the signals along the time sequence by holding the signals successively, by weighting them by a multiplication circuit and performing addition to successive signals (It is equivalent to the circuit of capacitive coupling CP3 or less in FIG. 4.). However, it is desired to further reduce the size of the circuit and electric power consumed.

SUMMARY OF THE INVENTION

The present invention solves the problem above by providing a weighted addition circuit for sampling, holding and performing weighted addition by a circuit smaller than conventional circuits.

According to the present invention, the weighted addition circuit includes a capacitive coupling connected to a plurality of switches which are further connected only to an input voltage. A voltage is held and a weight is added in the capacitive coupling.

According to the weighted addition circuit of the present invention, the size of the circuit is reduced because a capacitance for weighting is also used for holding data.

PREFERRED EMBODIMENT OF THE PRESENT INVENTION

Hereinafter a weighted addition circuit according to the present invention is described with reference to the attached drawings.

Figure 1:
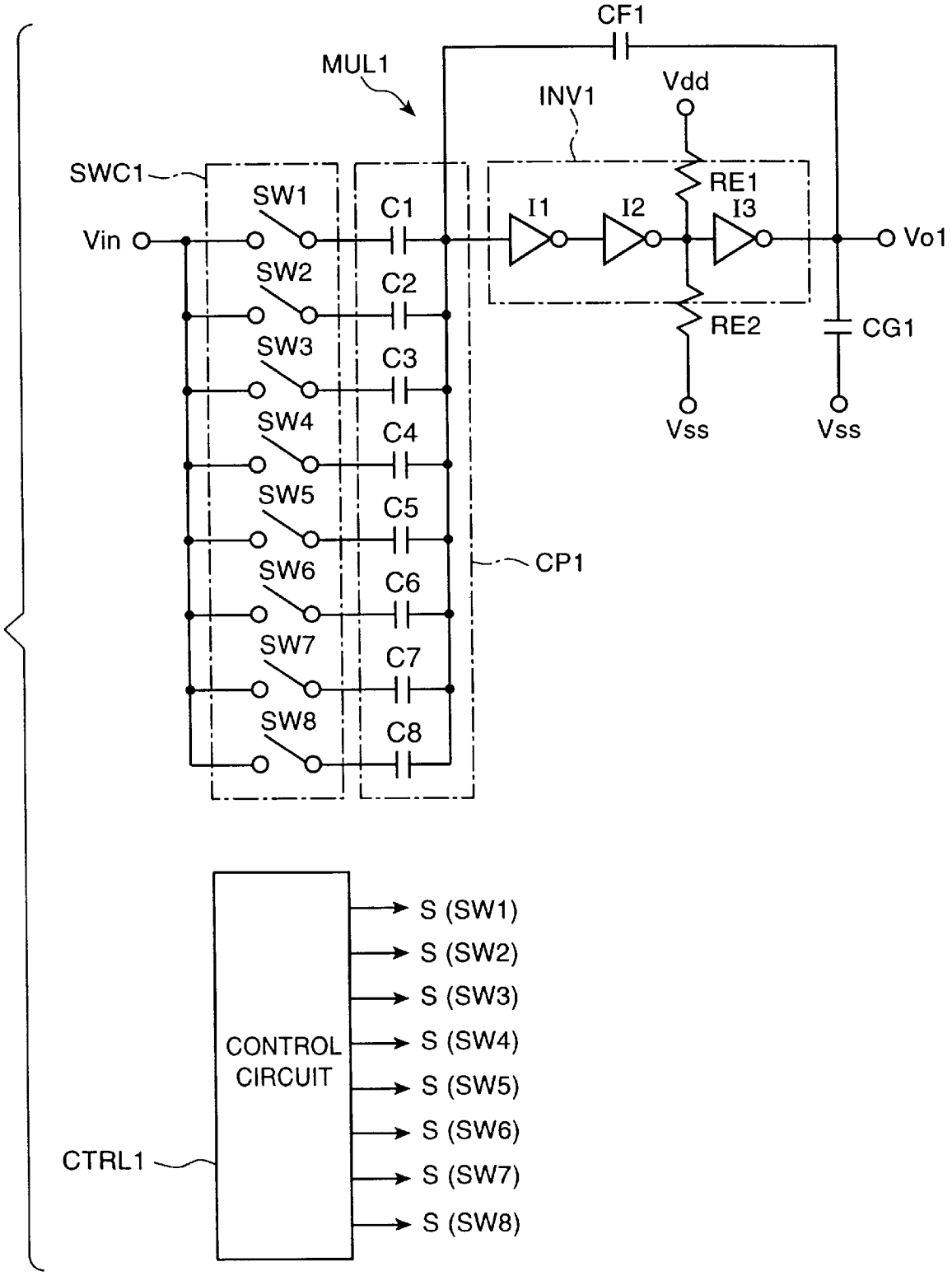
FIG. 1 shows the first embodiment of a weighted addition circuit of the present invention.

In FIG. 1, a weighted addition circuit MUL1 includes a switch circuit SWC1 having a plurality of switches of SW1, SW2, SW3, SW4, SW5, SW6, SW7 and SW8. The switches from SW1–SW8 are not connected to the ground. The switches SW1–SW8 control Vin to be connected or disconnected to the following circuit. Capacitances C1, C2, C3, C4, C5, C6, C7 and C8 are connected to the switches from SW1 to SW8, respectively. When the switch is closed, an electrical charge corresponding to the voltage Vin is held in a capacitance corresponding to the switch.

The outputs of capacitances from C1–C8 are integrated and a capacitive coupling CP1 is constructed. An output of the capacitive coupling CPI is connected to an inverted amplifying portion INV1 including an odd number comprising stages of MOS inverters I1, I2 and I3. An output of the inverted amplifying portion INV1 is connected to its input through a feedback capacitance CF1. An output of CP1 is generated as an output voltage Vo1 in the output of INV1 with good linearity.

The sum of the capacity of the capacitance connected to Vin(t) of an input at a time t after the switch is closed is called a momentarily effective composite capacity of CP1, and expressed as Σ CP1(t). When a capacitance once closed is not opened in the time from t0 to tn, the output Vo1(tn) on a time tn is the summation of the momentarily effective composed capacity and the product of the inputs is expressed by formula (1).

$$Vo1(tn) = -\sum_{i=10}^{m} Vin\{\Sigma CP1(t)/CF1\} \tag{1}$$

Formula (2) is defined and Vo1 is a normalized output of weighted addition.

$$C1+C2+C3+C4+C5+C6+C7+C8=CF1 \tag{2}$$

Vo1 is a normalized output of weighted addition.

When one capacitance is closed at a time and other capacitances are closed in a sequence, times weighted by the signals in time series are integrated, and when a plurality of capacitances are closable at the same time, a variety of weights can be realized by a composed capacity of capacitances. It is necessary to control the combination of weights on an addition of signals in a time sequence when a plurality of capacitances are used at the same time.

Switches from SW1–SW8 are controlled by a control circuit CTRL1. The signals for controlling the switches are output from CTRL1, as S(SW1), S(SW2), S(SW3), S(SW4), S(SW5), S(SW6), S(SW7), and S(SW8). Switches from SW1–SW8 are well-known analog switches. The circuit between a drain and a source is conductive, or nonconductive by inputting the signals to a gate of a p-type and n-type MOS transistor. The signals S(SW1)–S(SW8) are binary (i.e., high and low level). The circuit is conductive when the signal is high and nonconductive when it is low.

In the control circuit, weighted addition of successive analog signals is performed by making one of the signals a high level and the others low level. Then, the function of digital filter is realized. It is also possible to calculate the summation of multiplication values by a plurality of multipliers multiplied to one analog data. The number of switches in a switch circuit is not limited by the description above. It can be any number. In the capacitive coupling, the number of capacitances is set corresponding to the switches of the switch circuit. The combination of the capacity can be the weight of a filter, a digit of a binary number etc. With respect to inverted amplifying portion INV1, an output of I3 is grounded by a grounding capacitance CG1. An output of I2 is connected to the supply voltage Vdd and the ground by a pair of balancing resistances RE1 and RE2. Thus, unstable oscillation of inverted amplifying portion including feedback system is prevented.

Figure 2:
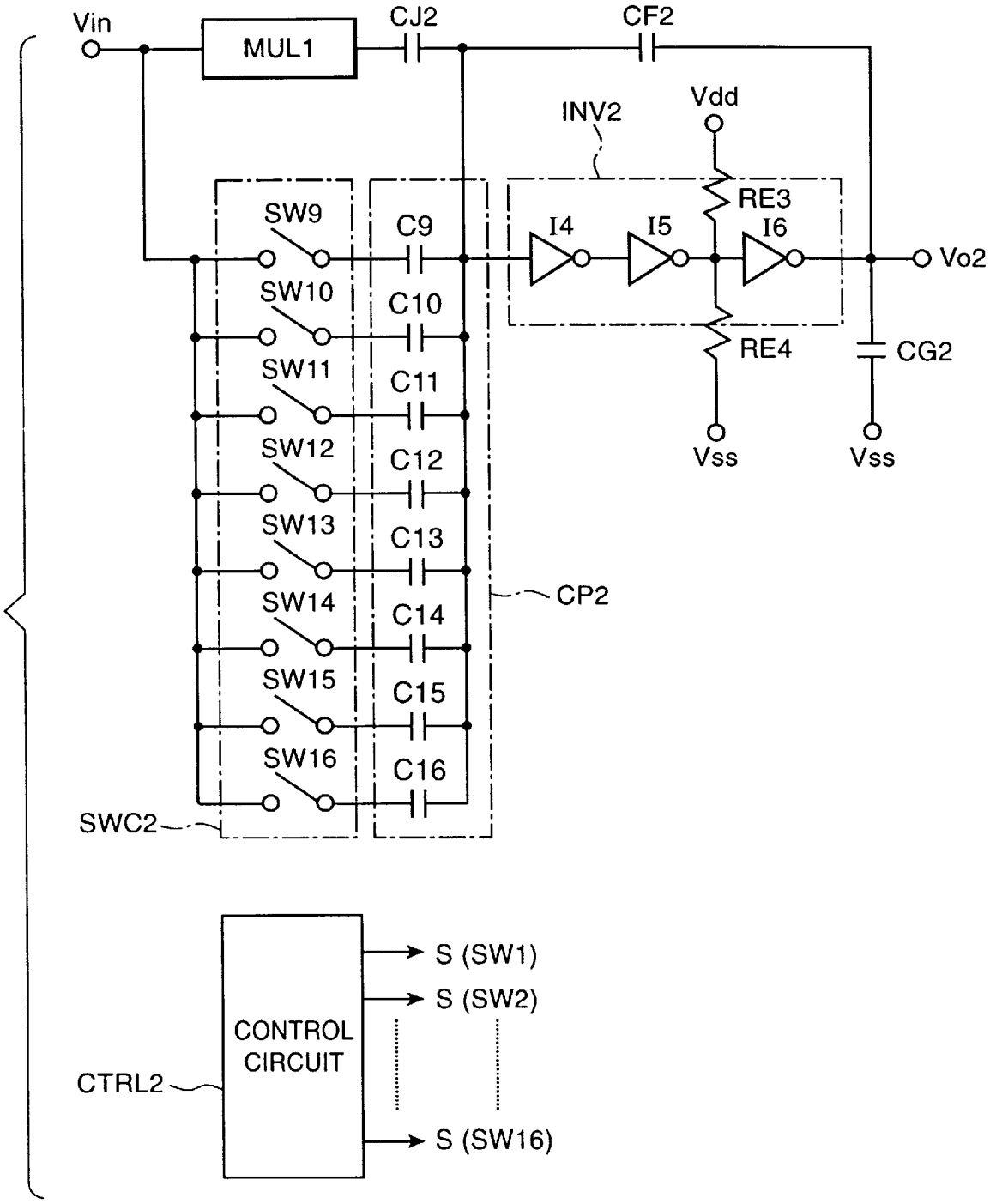
FIG. 2 shows a circuit according to the second embodiment of the present invention.

FIG. 2 shows the second embodiment of the present invention. A signed addition function is added to the circuit MUL1 in the first embodiment.

Input voltage Vin is connected in parallel to the MUL1 and a switch circuit SWC2. A capacitive coupling CP2 is connected to an output of the switch circuit SWC2. An output of weighted addition circuit MUL1 is connected to a capacitance CJ2 which is connected together with an output of CP2 to an inverted amplifying portion INV2. The structure of SWC2 is similar to that of SWC1. Switch circuit SWC2 includes a plurality of switches SW9, SW10, SW11, SW12, SW13, SW14, SW15 and SW16 which are connected in parallel. The structure of CP2 is similar to that of CP1. Capacitive coupling CP2 includes inputs of a plurality of capacitances C9, C10, C11, C12, C13, C14, C15 and C16 which are connected to corresponding switches, and outputs of the capacitances which are integrated.

The structure of inverted amplifying portion INV2 is similar to that of inverted amplifying portion INV1 for the first embodiment. The inverted amplifying portion INV includes an odd number of stages of MOS inverters I4, I5 and I6 which are connected in series. An output of INV2 is connected to its input by a feedback capacitance CF2, and is generated as output voltage Vo2 so that an input of INV1 is output with a good linearity.

The sum of the capacity of the capacitance connected to Vin(t) of an input at a time t after the switch is closed is called a momentarily effective composed capacity of CP2, and is expressed as Σ CP2(t). When a capacitance once connected is not disconnected in the time from t0 to tn, the output Vo2(tn) at a time tn is the summation of the momentarily effective composite capacity and the product of the inputs is expressed by the formula (3).

$$Vo2(tn) = -\sum_{i=10}^{m} Vin\{\Sigma CP2(t) + Vo1CJ2\}/CF2 \quad (3)$$

Here, formula (4) is defined.

$$CF2=C9+C10+C11+C12+C13+C14+C15+C16=CJ2=CF1 \quad (4)$$

Substituting formula (3) for formula (1), formula (5) is obtained.

$$\begin{aligned} Vo2 &= -\sum_{i=10}^{tn} Vin(t)\{\Sigma CP2(t) - \Sigma CP1(t)CJ2/CF1\}/CF2 \\ &= -\sum_{i=10}^{tn} Vin(t)\{\Sigma CP1(t) - \Sigma CP2(t)\}/CF2 \end{aligned} \quad (5)$$

This means that weighted addition is accomplished with the sign of a signal in a time sequence of Vin. From the relation in formula (4), the output of the normalized and the maximum value of Vo2 is also Vdd when the maximum value of Vin is the supply voltage Vdd.

The switches SW1–SW8 of MUL1 and SW9–SW16 above are controlled by control circuit CTRL2. The signals for controlling the switches are output from CTRL2 as S(SW1), S(SW2), S(SW3), S(SW4), S(SW5), S(SW6), S(SW7), S(SW8), S(SW9), S(SW10), S(SW11), S(SW12), S(SW13), S(SW14), S(SW15) and S(SW16). The switches from SW9–SW16 are well-known analog switches similar to the switches from SW1–SW8.

In the control circuit, sequentially, either one of the signals has a high level and another is at a low level and the weighted addition with a sign of an analog signal in a time sequence is performed. Also, in the inverted amplifying portion INV2, unstable oscillation is prevented by the grounded capacitance CG2, and balancing resistances RE3 and RE4.

Figure 3:
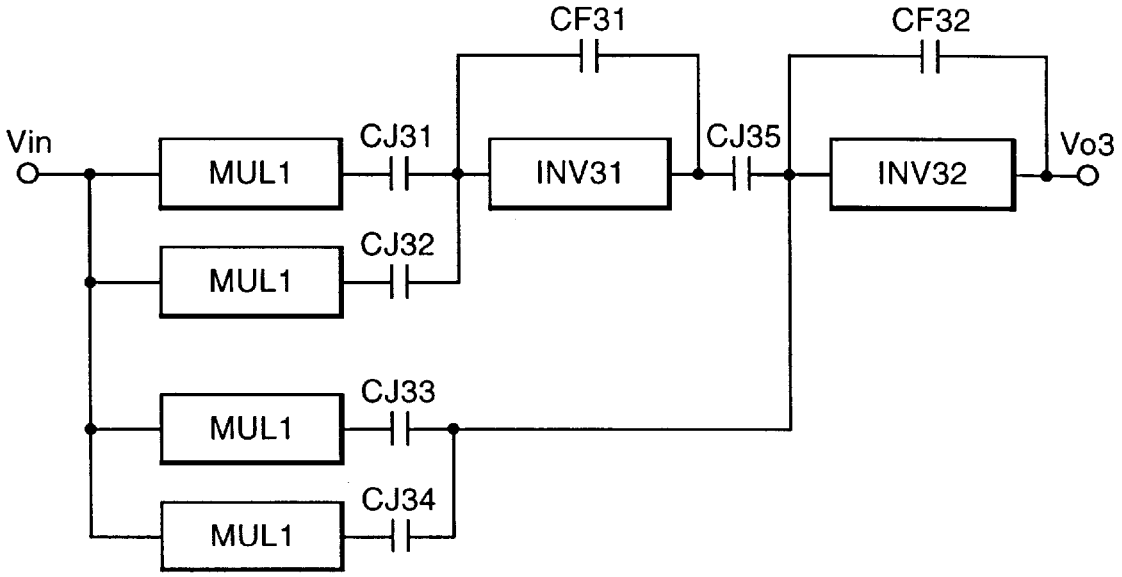
FIG. 3 shows a circuit according to the third embodiment of the present invention.
Figure 4:
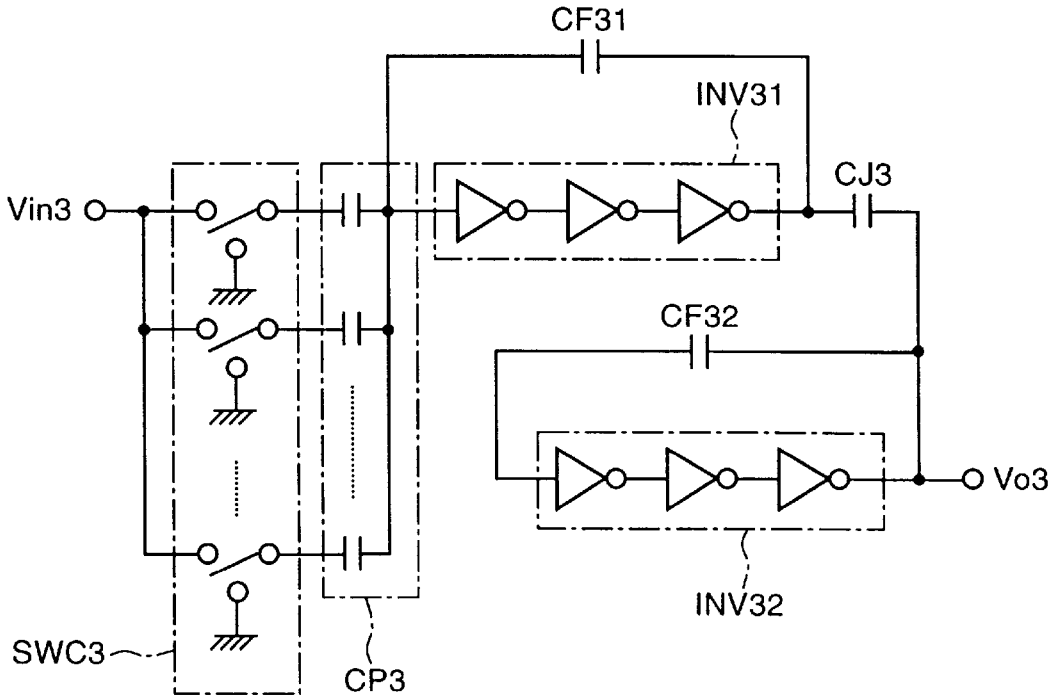
Fig. 4 (PRIOR ART)
FIG. 4 shows a conventional multiplication circuit.
Figure 5:
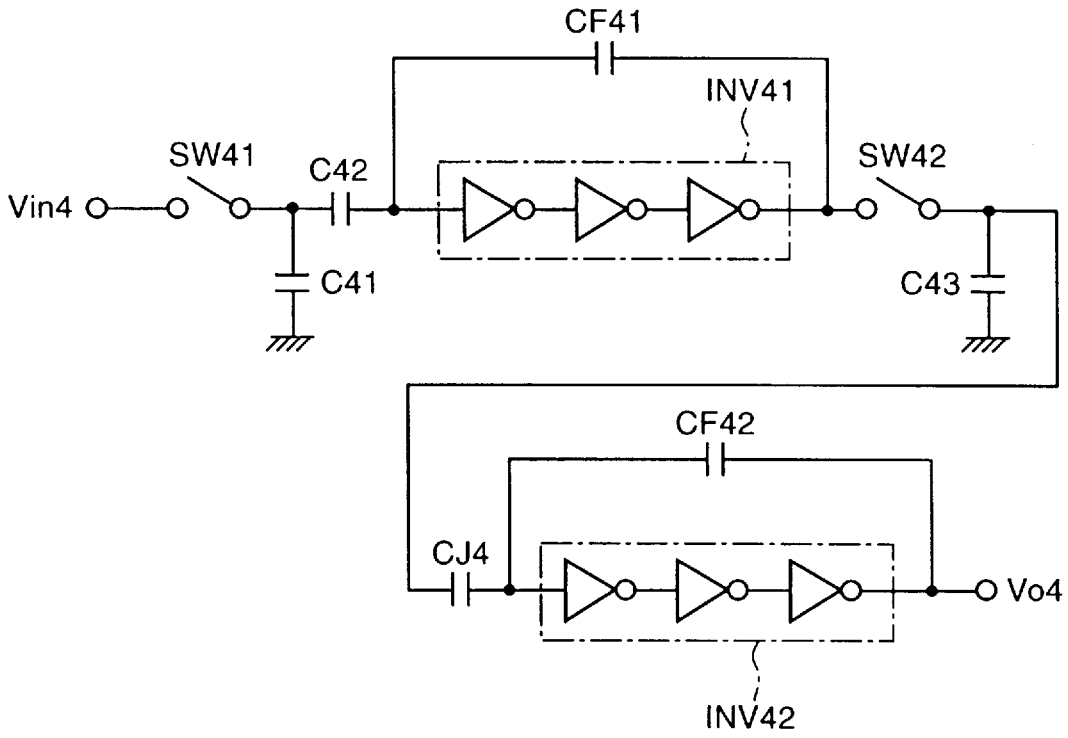
Fig. 5 (PRIOR ART)
FIG. 5 shows a circuit of a conventional sampling and holding circuit.

In FIG. 3, the structure for performing weighted addition on a plurality of the results of the weighted addition. On the positive side, input voltage Vin is input to connecting capacitances CJ31 and CJ32 through a plurality of weighted addition circuits MUL1. Outputs of the capacitances are input to an integrated and inverted amplifying portion INV31. Input voltage Vin is input to connecting capacitances CJ33 and CJ34 through a plurality of weighted addition circuit MUL1 on the negative side, and an output of INV31 is input to a connecting capacitance CJ35. Outputs of CJ33, CJ34 and CJ35 are integrated and input to inverted amplifying portion INV32. Then, a signed weighted addition of a complex type is obtained as Vo3 of the output of INV32.

Assuming the input to CJ31, CJ32, CJ33 and CJ34 to be m1Vin, m2Vin, m3Vin, m4Vin (m1–m4 are multipliers by the weighted addition circuit) and feedback capacitances of INV31 and INV32 to be CF31 and CF32, respectively, and CF31=CJ35, formula (6) is obtained.

$$Vo3=\{m1CJ31+m2CJ32)-(m3CJ33+m4CJ34\}Vin/CF32 \quad (6)$$

A signed weighted addition of multiplication result is performed in formula (6). That is, using a combination of the first and the second embodiments, a more complicated operation can be performed.

As mentioned above, in the weighted addition circuit according to the present invention, a capacitive coupling is connected to a plurality of switches which is further connected only to an input voltage. A voltage is held and a weight is added in the capacitive coupling. Therefore, the size of the circuit and consumed electricity are reduced.

What is claimed is:

1. A weighted addition circuit comprising:

i) a first switch circuit having a plurality of switches connected in parallel to an input voltage;

ii) a first capacitive coupling having a plurality of capacitances respectively connected to outputs of said switches of said first switch circuit, the outputs of said capacitances forming an integrated output;

iii) a first inverted amplifying portion having an odd number of MOS inverters connected in series, said first inverted amplifying portion being connected to said integrated output of said first capacitive coupling;

iv) a first feedback capacitance for connecting an output of said first inverted amplifying portion to an input of said first inverted amplifying portion;

v) a first control circuit for closing each of said switches of said first switch circuit;

vi) a second switch circuit having a plurality of switches connected in parallel to said input voltage and corresponding to said switches of said first switch circuit;

vii) a second capacitive coupling having a plurality of capacitances corresponding to said capacitances of said first capacitive coupling and respectively connected to outputs of said switches of said second switch circuit, the outputs of said capacitances of said second capacitive coupling forming a second integrated output;

viii) a second inverted amplifying portion having an odd number of MOS inverters connected in series, said second inverted amplifying portion being connected to said second integrated output of said second capacitive coupling;

ix) a connecting capacitance for connecting an input of said second inverted amplifying portion and the output of said first inverted amplifying portion;

x) a second feedback capacitance for connecting an output of said second inverted amplifying portion to the input of said second inverted amplifying portion; and xi) a second control circuit for closing each of said switches in said first and second switch circuits;

wherein a capacity of said second feedback capacitance is set equal to a sum of a capacities of said second capacitive coupling and also equal to a capacity of said connecting capacitance.

2. A weighted addition circuit as claimed in 1, wherein a capacity of said first feedback capacitance is set equal to a sum of capacities of said first capacitive coupling.

3. A weighted addition circuit as claimed in claim 1, wherein said first switch circuit and said first capacitive coupling are operatively coupled so as to sample and hold a first signal corresponding to said input voltage.

4. A weighted addition circuit as claimed in claim 3, wherein said second switch circuit and said second capacitive coupling are operatively connected so as to sample and hold a second signal corresponding to said input voltage.

5. A weighted addition circuit comprising:

i) a first switch circuit having a plurality of switches connected in parallel to an input voltage;

ii) a first capacitive coupling having a plurality of capacitances respectively connected to outputs of said switches of said first switch circuit, the outputs of said capacitances forming an integrated output;

iii) a first inverted amplifying portion having an odd number of MOS inverters connected in series, said first inverted amplifying portion being connected to said integrated output of said first capacitive coupling;

iv) a first feedback capacitance for connecting an output of said first inverted amplifying portion to an input of said first inverted amplifying portion;

v) a first control circuit for closing each of said switches of said first switch circuit;

vi) a second switch circuit having a plurality of switches connected in parallel to said input voltage and corresponding to said switches of said first switch circuit;

vii) a second capacitive coupling having a plurality of capacitances corresponding to said capacitances of said first capacitive coupling and respectively connected to outputs of said switches of said second switch circuit, the outputs of said capacitances of said second capacitive coupling forming a second integrated output;

viii) a second inverted amplifying portion having an odd number of MOS inverters connected in series, said second inverted amplifying portion being connected to said second integrated output of said second capacitive coupling;

ix) a connecting capacitance for connecting an input of said second inverted amplifying portion and the output of said first inverted amplifying portion;

x) a second feedback capacitance for connecting an output of said second inverted amplifying portion to the input of said second inverted amplifying portion;

xi) a second control circuit for closing each of said switches in said first and second switch circuits;

xii) first and second balancing resistances;

wherein said first and second balancing resistances each have a first end connected to an output of one of said MOS inverters of said first inverted amplifying portion;

a second end of said first balancing resistance receives a supply voltage and a second end of said second balancing resistance is grounded; and wherein a capacity of said second feedback capacitance is set equal to a sum of a capacities of said second capacitive coupling and also equal to a capacity of said connecting capacitance.

6. A weighted addition circuit as claimed in claim 5, further comprising:

third and fourth balancing resistances, wherein said third and fourth balancing resistances each have a first end connected to an output of one of said MOS inverters of said second inverted amplifying portion, and a second end of said third balancing resistance receives a supply voltage and a second end of said fourth balancing resistance is grounded.

* * * * *